US009885309B1

(12) United States Patent
Hollar et al.

(10) Patent No.: US 9,885,309 B1
(45) Date of Patent: Feb. 6, 2018

(54) METHODS AND SYSTEMS FOR DUAL FUEL INJECTION

(71) Applicant: Ford Global Technologies, LLC, Dearborn, MI (US)

(72) Inventors: Paul Hollar, Belleville, MI (US); Ron Reichenbach, Troy, MI (US); Ethan D. Sanborn, Saline, MI (US); Daniel Dusa, West Bloomfield, MI (US); Joseph Lyle Thomas, Kimball, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 36 days.

(21) Appl. No.: 15/214,232

(22) Filed: Jul. 19, 2016

(51) Int. Cl.
*F02D 41/30* (2006.01)

(52) U.S. Cl.
CPC ..... *F02D 41/3094* (2013.01); *F02D 41/3076* (2013.01)

(58) Field of Classification Search
CPC ... F02D 41/30; F02D 41/3094; F02D 41/3076
See application file for complete search history.

(56) References Cited

U.S. PATENT DOCUMENTS

| | | | | |
|---|---|---|---|---|
| 7,726,277 | B2 * | 6/2010 | Kuo | F02D 13/0203 123/304 |
| 8,100,107 | B2 | 1/2012 | Bidner et al. | |
| 9,255,541 | B2 | 2/2016 | Sumilla et al. | |
| 9,284,906 | B2 * | 3/2016 | Yun | F02D 41/3035 |
| 9,303,577 | B2 | 4/2016 | Sumilla et al. | |
| 9,599,060 | B2 * | 3/2017 | Sanborn | F02M 59/20 |
| 2013/0332052 | A1 | 12/2013 | Louven et al. | |

* cited by examiner

*Primary Examiner* — Hieu T Vo
(74) *Attorney, Agent, or Firm* — Julia Voutyras; McCoy Russell LLP

(57) ABSTRACT

Methods and a system are provided for controlling fuel injection in a vehicle engine. The system specifically relates to an engine fueled with both port and direct fuel injectors. In one example, a method may include delivering a first portion of fuel via port injection during a first injection window, and subsequently delivering a second portion of fuel directly during a second injection window before the engine exits cranking speeds.

20 Claims, 3 Drawing Sheets

METHODS AND SYSTEMS FOR DUAL FUEL INJECTION

FIELD

The present description relates generally to methods and systems for an engine configured with both port and direct fuel injection capabilities.

BACKGROUND AND SUMMARY

Engines may use various forms of fuel delivery to provide a desired amount of fuel for combustion in each cylinder. One type of fuel delivery uses a port injector for each cylinder to deliver fuel to respective cylinders. Still another type of fuel delivery uses a direct injector for each cylinder. Direct fuel injection (DI) systems may improve cylinder charge cooling so that engine cylinders may operate at higher compression ratios without incurring undesirable engine knock. Port fuel injection (PFI) systems may reduce particulate emissions and improve fuel vaporization. In addition, port injection may reduce pumping losses at low loads. To leverage the advantages of both types of fuel injection, engines may also be configured with each of port and direct injection. Therein, based on engine operating conditions, such as engine speed-load ranges, fuel may be delivered via only direct injection, only port injection, or a combination of both types of injection. For example, during an engine restart, the engine may be fueled with each of port and direct injection, with the split ratio adjusted based on one or more engine operating conditions.

One example approach for operating an engine with dual fueling capabilities is shown by Bidner et al. in U.S. Pat. No. 8,100,107. Therein the split ratio for engine fueling includes a higher portion of the fuel mass commanded during an engine cold-start being provided via port injection, and a remaining smaller portion being provided via direct injection. By increasing the ratio of port injected fuel in the fuel split, particulate matter emissions are reduced.

However the inventors herein have identified potential issues with such an approach. As one example, during an engine start, as combustion occurs on a first few events counted since the first combustion event of the engine, engine speed may or may not increase predictably. The speed profile may be affected by numerous factors including engine temperature, component wear causing changes in friction, spark plug degradation, fuel quality, low battery voltage causing slow cranking speeds, etc. Engines may be calibrated to start with larger fuel masses in the first fueling events/engine cycles until the engine exits cranking speeds. If the threshold for exiting cranking engine speed is exceeded in the middle of the fueling cycle for one or more cylinders, and if the desired fuel mass decreases during this fueling cycle, the dual fueled engine may choose to honor the lower desired fuel mass by trimming the fuel pulse commanded to the DI fuel injector. As a result, a target split ratio between the PFI and DI injector is not preserved during this combustion event. In particular, the DI fuel mass may be decreased (or eliminated) if the desired fuel mass decreases by a large amount as the engine exits cranking speeds, or if the decrease is commanded late in the port fueling window (when port injection adjustments are not possible). The deviation from a calibrated split ratio for fuel delivery can have a significant effect on mixture formation. In addition, the deviation from the calibrated split ratio can have cascading effects on other engine operating parameters, such as a deviation from a calibrated spark timing. As a result, combustion stability and robustness may be affected during engine starts. Further, the engine start reliability and repeatability may be reduced.

In one example, some of the above issues may be addressed by a method for an engine comprising: for a first number of consecutive combustion events counted from a first combustion event of an engine start from rest, fueling an engine with each of port and direct injection; and maintaining a ratio of fuel injected via port injection relative to direct injection over the first number of combustion events even as fuel mass changes. In this way, the calibrated split ratio can be prioritized during the engine start until the cranking speed is reached, and then the calibrated fuel mass can be prioritized.

As one example, during an engine start from rest, the engine may be fueled via each of port and direct injection. A calibrated split ratio of fuel delivered via port injection relative to direct injection may be determined based on engine conditions at the engine start (such as engine temperature). For the first combustion event of the start, as well as for a first number of combustion events counted as occurring consecutively after the first combustion event (with no intervening combustion events in between), the calibrated fuel split ratio may be maintained even as fuel mass changes. For example, if a decrease in fuel mass is commanded, the fuel mass is decreased by trimming both the port injection (PFI) fuel pulse and the direct injection (DI) fuel pulse proportionately so that the split ratio is maintained. For example, the end of injection timing of both the PFI and DI fuel pulses may be advanced. As such, this may be possible if the commanded decrease in fuel mass is received earlier in the port injection fueling window (e.g., before an abort angle of the port injection window is reached). If the commanded decrease in fuel mass is received later in the port injection fueling window (e.g., after the abort angle is reached), trimming of the port injection pulse may not be possible. In this case, instead of trimming the DI fuel pulse to provide the commanded fuel mass at the expense of the commanded split ratio, the DI fuel pulse is maintained so as to maintain the commanded split ratio at the expense of the commanded fuel mass. That is, the actual fuel mass delivered may be higher than the commanded fuel mass. After the first number of combustion events have elapsed, the commanded split ratio may be varied to accommodate changes in a commanded fuel mass.

In this way, a more robust engine calibration may be provided across engine starts, even as factors that could affect the start change. By selectively disregarding a commanded decrease in fuel mass received in the middle of a combustion event during engine cranking, a calibrated fuel split ratio may be maintained for a defined number of combustion events counted from the engine start. As such, this reduces variations in mixture formation and deviations from a calibrated spark timing. By prioritizing the commanded split ratio over the commanded fuel mass for the defined number of combustion events from the start, engine start variability arising from sudden changes in fuel mass may be reduced. Overall, engine start combustion stability is improved. In addition, engine starts are made more reliable and repeatable.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
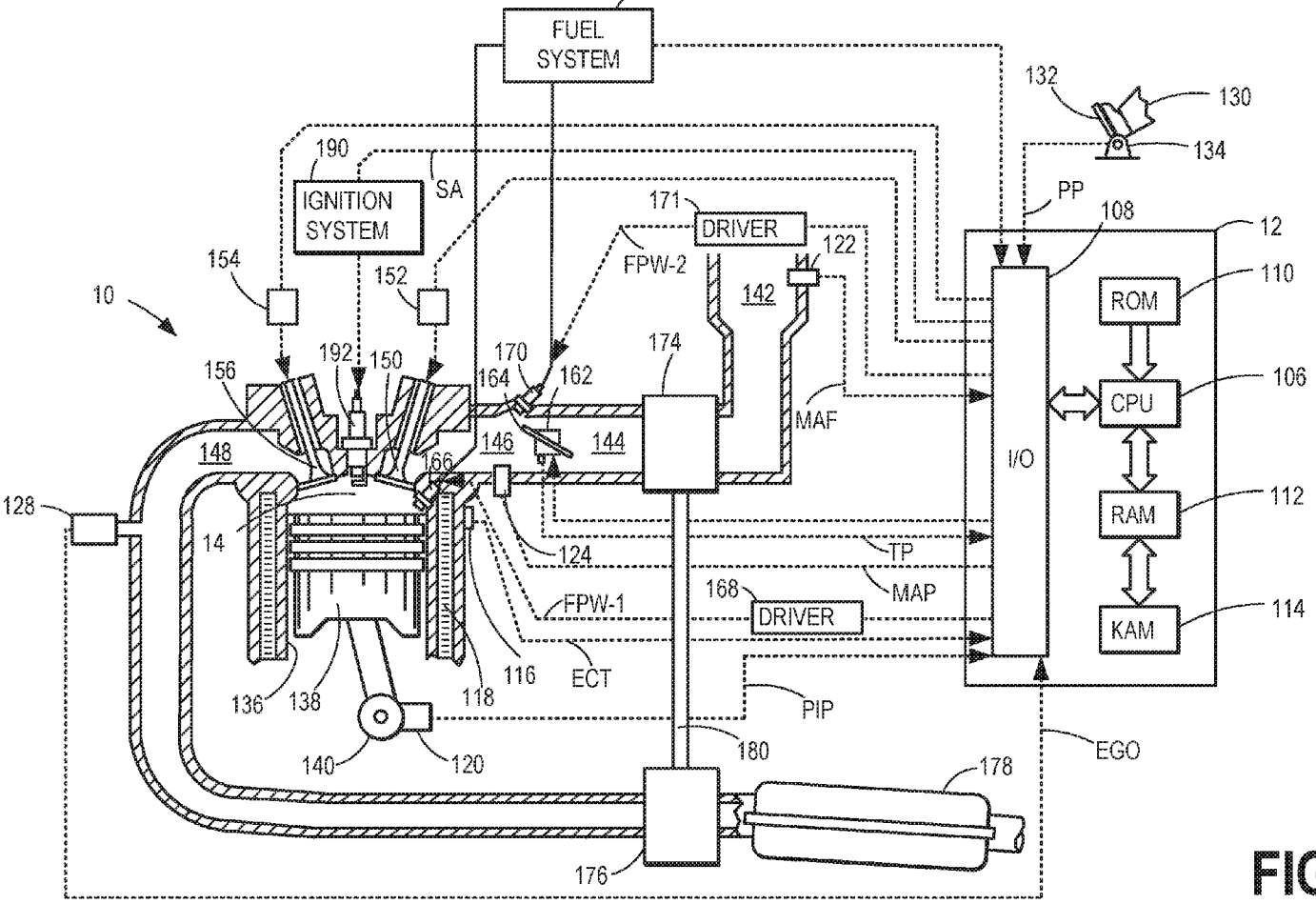
FIG. 1 schematically depicts an example embodiment of a cylinder of an internal combustion engine configured with dual fuel injection capabilities.

The following detailed description provides information regarding adjusting fueling of a vehicle engine during an initial number of combustion events of an engine start to improve combustion stability until the engine exits cranking speeds. An example embodiment of a cylinder in an internal combustion engine configured for each of port and direct injection is shown at FIG. 1. A controller may be configured to perform a control routine, such as the example routine of FIG. 2, to selectively trim a port and direct injection fuel pulse responsive to a decrease in fuel mass commanded during an initial number of combustion events of an engine start. Example fuel injection adjustments to direct and port injection fuel pulses during an engine start are shown at FIG. 3.

Regarding terminology used throughout this detailed description, port fuel injection may be abbreviated as PFI while direct injection may be abbreviated as DI.

FIG. 1 depicts an example of a combustion chamber or cylinder of internal combustion engine 10. Engine 10 may be controlled at least partially by a control system including controller 12 and by input from a vehicle operator 130 via an input device 132. In this example, input device 132 includes an accelerator pedal and a pedal position sensor 134 for generating a proportional pedal position signal PP. Cylinder (herein also "combustion chamber") 14 of engine 10 may include combustion chamber walls 136 with piston 138 positioned therein. Piston 138 may be coupled to crankshaft 140 so that reciprocating motion of the piston is translated into rotational motion of the crankshaft. Crankshaft 140 may be coupled to at least one drive wheel of the passenger vehicle via a transmission system. Further, a starter motor (not shown) may be coupled to crankshaft 140 via a flywheel to enable a starting operation of engine 10.

Cylinder 14 can receive intake air via a series of intake air passages 142, 144, and 146. Intake air passage 146 can communicate with other cylinders of engine 10 in addition to cylinder 14. In some examples, one or more of the intake passages may include a boosting device such as a turbocharger or a supercharger. For example, FIG. 1 shows engine 10 configured with a turbocharger including a compressor 174 arranged between intake passages 142 and 144, and an exhaust turbine 176 arranged along exhaust passage 148. Compressor 174 may be at least partially powered by exhaust turbine 176 via a shaft 180 where the boosting device is configured as a turbocharger. However, in other examples, such as where engine 10 is provided with a supercharger, exhaust turbine 176 may be optionally omitted, where compressor 174 may be powered by mechanical input from a motor or the engine. A throttle 162 including a throttle plate 164 may be provided along an intake passage of the engine for varying the flow rate and/or pressure of intake air provided to the engine cylinders. For example, throttle 162 may be positioned downstream of compressor 174 as shown in FIG. 1, or alternatively may be provided upstream of compressor 174.

Exhaust passage 148 can receive exhaust gases from other cylinders of engine 10 in addition to cylinder 14. Exhaust gas sensor 128 is shown coupled to exhaust passage 148 upstream of emission control device 178. Sensor 128 may be selected from among various suitable sensors for providing an indication of exhaust gas air/fuel ratio such as a linear oxygen sensor or UEGO (universal or wide-range exhaust gas oxygen), a two-state oxygen sensor or EGO (as depicted), a HEGO (heated EGO), a NOx, HC, or CO sensor, for example. Emission control device 178 may be a three way catalyst (TWC), NOx trap, various other emission control devices, or combinations thereof.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some examples, each cylinder of engine 10, including cylinder 14, may include at least two intake poppet valves and at least two exhaust poppet valves located at an upper region of the cylinder.

Intake valve 150 may be controlled by controller 12 via actuator 152. Similarly, exhaust valve 156 may be controlled by controller 12 via actuator 154. During some conditions, controller 12 may vary the signals provided to actuators 152 and 154 to control the opening and closing of the respective intake and exhaust valves. The position of intake valve 150 and exhaust valve 156 may be determined by respective valve position sensors (not shown). The valve actuators may be of the electric valve actuation type or cam actuation type, or a combination thereof. The intake and exhaust valve timing may be controlled concurrently or any of a possibility of variable intake cam timing, variable exhaust cam timing, dual independent variable cam timing or fixed cam timing may be used. Each cam actuation system may include one or more cams and may utilize one or more of cam profile switching (CPS), variable cam timing (VCT), variable valve timing (VVT) and/or variable valve lift (VVL) systems that may be operated by controller 12 to vary valve operation. For example, cylinder 14 may alternatively include an intake valve controlled via electric valve actuation and an exhaust valve controlled via cam actuation including CPS and/or VCT. In other examples, the intake and exhaust valves may be controlled by a common valve actuator or actuation system, or a variable valve timing actuator or actuation system.

Cylinder 14 can have a compression ratio, which is the ratio of volumes when piston 138 is at bottom center to top center. In one example, the compression ratio is in the range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock.

In some examples, each cylinder of engine 10 may include a spark plug 192 for initiating combustion. Ignition system 190 can provide an ignition spark to combustion chamber 14 via spark plug 192 in response to spark advance signal SA from controller 12, under select operating modes. However, in some embodiments, spark plug 192 may be omitted, such as where engine 10 may initiate combustion by auto-ignition or by injection of fuel as may be the case with some diesel engines.

In some examples, each cylinder of engine 10 may be configured with one or more fuel injectors for providing fuel thereto. As a non-limiting example, cylinder 14 is shown including two fuel injectors 166 and 170. Fuel injectors 166 and 170 may be configured to deliver fuel received from fuel system 8. Fuel system 8 may include one or more fuel tanks, fuel pumps, and fuel rails. Fuel injector 166 is shown coupled directly to cylinder 14 for injecting fuel directly therein in proportion to the pulse width of signal FPW-1 received from controller 12 via electronic driver 168. In this manner, fuel injector 166 provides what is known as direct injection (hereafter referred to as "DI") of fuel into combustion cylinder 14. While FIG. 1 shows injector 166 positioned to one side of cylinder 14, it may alternatively be located overhead of the piston, such as near the position of spark plug 192. Such a position may improve mixing and combustion when operating the engine with an alcohol-based fuel due to the lower volatility of some alcohol-based fuels. Alternatively, the injector may be located overhead and near the intake valve to improve mixing. Fuel may be delivered to fuel injector 166 from a fuel tank of fuel system 8 via a high pressure fuel pump, and a fuel rail. Further, the fuel tank may have a pressure transducer providing a signal to controller 12.

Fuel injector 170 is shown arranged in intake passage 146, rather than in cylinder 14, in a configuration that provides what is known as port injection of fuel (hereafter referred to as "PFI") into the intake port upstream of cylinder 14. Fuel injector 170 may inject fuel, received from fuel system 8, in proportion to the pulse width of signal FPW-2 received from controller 12 via electronic driver 171. Note that a single driver 168 or 171 may be used for both fuel injection systems, or multiple drivers, for example driver 168 for fuel injector 166 and driver 171 for fuel injector 170, may be used, as depicted.

In an alternate example, each of fuel injectors 166 and 170 may be configured as direct fuel injectors for injecting fuel directly into cylinder 14. In still another example, each of fuel injectors 166 and 170 may be configured as port fuel injectors for injecting fuel upstream of intake valve 150. In yet other examples, cylinder 14 may include only a single fuel injector that is configured to receive different fuels from the fuel systems in varying relative amounts as a fuel mixture, and is further configured to inject this fuel mixture either directly into the cylinder as a direct fuel injector or upstream of the intake valves as a port fuel injector. As such, it should be appreciated that the fuel systems described herein should not be limited by the particular fuel injector configurations described herein by way of example.

Fuel may be delivered by both injectors to the cylinder during a single cycle of the cylinder. For example, each injector may deliver a portion of a total fuel injection that is combusted in cylinder 14 in accordance with a calibrated split ratio. Further, the distribution and/or relative amount of fuel delivered from each injector (that is, the split ratio) may vary with operating conditions, such as engine load, engine temperature, knock, exhaust temperature, as well as combustion event number as counted from a first combustion event since an engine start. The port injected fuel may be delivered during an open intake valve event, closed intake valve event (e.g., substantially before the intake stroke), as well as during both open and closed intake valve operation. As such, by delivering port injected fuel during a closed intake valve event, air-fuel mixture formation is improved (as compared to during open intake valve operation). Similarly, directly injected fuel may be delivered during an intake stroke, as well as partly during a previous exhaust stroke, during the intake stroke, and partly during the compression stroke, for example. As such, even for a single combustion event, injected fuel may be injected at different timings from the port and direct injector. Furthermore, for a single combustion event, multiple injections of the delivered fuel may be performed per cycle. The multiple injections may be performed during the compression stroke, intake stroke, or any appropriate combination thereof.

As described above, FIG. 1 shows only one cylinder of a multi-cylinder engine. As such, each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 1 with reference to cylinder 14.

Fuel injectors 166 and 170 may have different characteristics. These include differences in size, for example, one injector may have a larger injection hole than the other. Other differences include, but are not limited to, different spray angles, different operating temperatures, different targeting, different injection timing, different spray characteristics, different locations etc. Moreover, depending on the distribution ratio of injected fuel among injectors 170 and 166, different effects may be achieved.

Fuel tanks in fuel system 8 may hold fuels of different fuel types, such as fuels with different fuel qualities and different fuel compositions. The differences may include different alcohol content, different water content, different octane, different heats of vaporization, different fuel blends, and/or combinations thereof etc. One example of fuels with different heats of vaporization could include gasoline as a first fuel type with a lower heat of vaporization and ethanol as a second fuel type with a greater heat of vaporization. In another example, the engine may use gasoline as a first fuel type and an alcohol containing fuel blend such as E85 (which is approximately 85% ethanol and 15% gasoline) or M85 (which is approximately 85% methanol and 15% gasoline) as a second fuel type. Other feasible substances include water, methanol, a mixture of alcohol and water, a mixture of water and methanol, a mixture of alcohols, etc.

In still another example, both fuels may be alcohol blends with varying alcohol composition wherein the first fuel type may be a gasoline alcohol blend with a lower concentration of alcohol, such as E10 (which is approximately 10% ethanol), while the second fuel type may be a gasoline alcohol blend with a greater concentration of alcohol, such as E85 (which is approximately 85% ethanol). Additionally, the first and second fuels may also differ in other fuel qualities such as a difference in temperature, viscosity, octane number, etc. Moreover, fuel characteristics of one or both fuel tanks may vary frequently, for example, due to day to day variations in tank refilling.

Controller 12 is shown in FIG. 1 as a microcomputer, including microprocessor unit 106, input/output ports 108, an electronic storage medium for executable programs and calibration values shown as non-transitory read only memory chip 110 in this particular example for storing executable instructions, random access memory 112, keep alive memory 114, and a data bus. Controller 12 may receive various signals from sensors coupled to engine 10, in addition to those signals previously discussed, including measurement of inducted mass air flow (MAF) from mass air flow sensor 122; engine coolant temperature (ECT) from temperature sensor 116 coupled to cooling sleeve 118; a profile ignition pickup signal (PIP) from Hall effect sensor 120 (or other type) coupled to crankshaft 140; throttle position (TP) from a throttle position sensor; and absolute manifold pressure signal (MAP) from sensor 124. Engine speed signal, RPM, may be generated by controller 12 from signal PIP. Manifold pressure signal MAP from a manifold pressure sensor may be used to provide an indication of vacuum, or pressure, in the intake manifold. The controller 12 receives signals from the various sensors of FIG. 1 and employs the various actuators of FIG. 1 to adjust engine operation based on the received signals and instructions stored on a memory of the controller. For example, the adjusting may include the controller sending a signal to the port fuel injector responsive to a commanded decrease in fuel mass to advance an end of injection timing of a port injection fuel pulse. The controller may also send a signal to the direct fuel injector responsive to change in port injection fuel pulse to advance an end of injection timing of a direct injection fuel pulse so as to maintain a calibrated fuel split ratio even as the commanded fuel mass changes. An example control routine is described herein with reference to FIG. 2.

In this way, the system of FIG. 1 enables an engine fuel system, comprising: an engine cylinder; a direct injector coupled to the cylinder; a port injector coupled to the cylinder; and a controller. The controller may be configured with computer readable instructions stored on non-transitory memory for: restarting an engine with fuel delivered into the cylinder on a first combustion event from rest from each of the port injector and the direct injector at a ratio; adjusting a fuel mass commanded to the cylinder based on a combustion event number since the first combustion event until a threshold number of combustion events have elapsed; when a commanded decrease in fuel mass is received within a threshold number of crank angle degrees of a port injection window, adjusting each of a port injection fuel pulse and a direct injection fuel pulse to provide the commanded decrease in fuel mass while adjusting the ratio; and when the commanded decrease in fuel mass is received outside the threshold number of crank angle degrees of the port injection window, maintaining each of the port injection fuel pulse and the direct injection fuel pulse to maintain the ratio while providing an actual fuel mass that is higher than a commanded fuel mass. In the preceding example system, adjusting each of the port injection fuel pulse and the direct injection fuel pulse includes advancing an end of injection timing of each of the port injection fuel pulse and the direct injection fuel pulse. In the preceding example system, maintaining each of the port injection fuel pulse and the direct injection fuel pulse includes maintaining the end of injection timing of each of the port injection fuel pulse and the direct injection fuel pulse. Herein the ratio is based on an engine temperature estimated before the first combustion event at the engine start, the ratio including a higher proportion of port injected fuel relative to direct injected fuel as the engine temperature decreases.

Figure 2:
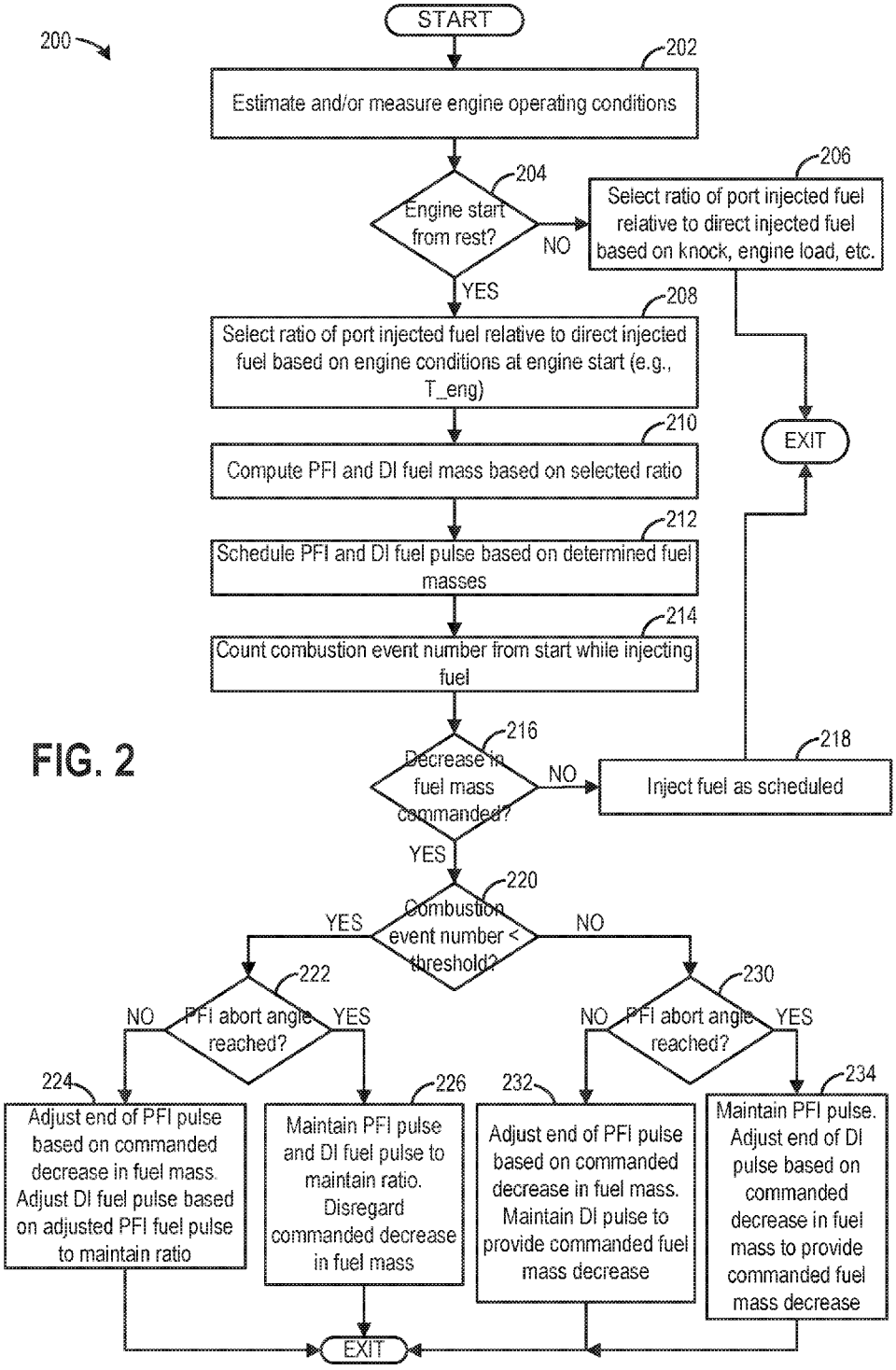
FIG. 2 depicts a high level flow chart of a method for adjusting each of a direct and port injection fuel pulse during an engine start responsive to a commanded change in fuel mass.
Figure 3:
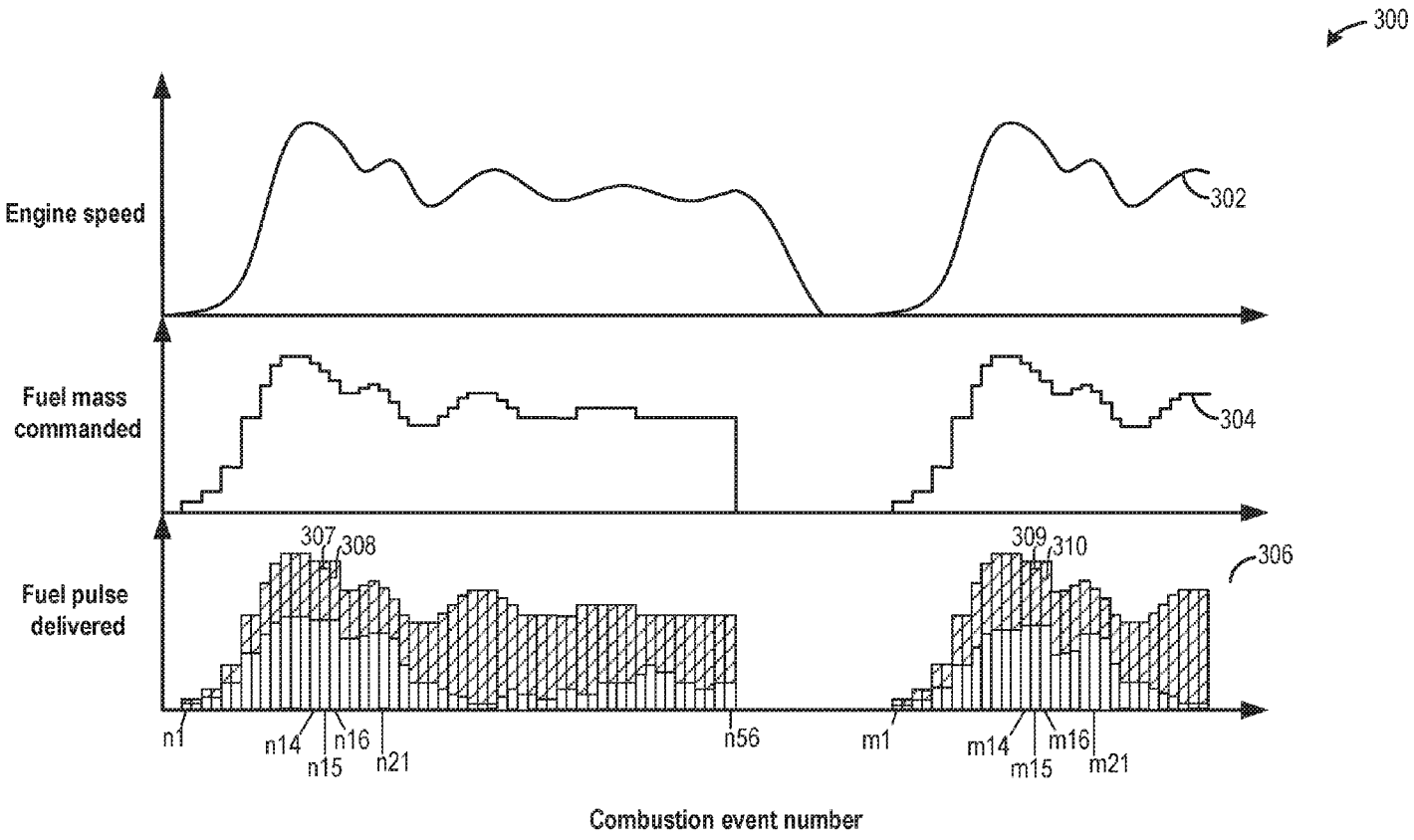
FIG. 3 depicts example adjustments to each of a direct and port injection fuel pulse during an engine start, according to the present disclosure.

Turning now to FIG. 2, a method 200 is described for increasing robustness of engine starts by maintaining a calibrated split ratio of fuel delivered via port injection relative to direct injection over each of a defined number of combustion events counted since an engine start, even as fuel mass changes. Instructions for carrying out method 200 and the rest of the methods included herein may be executed by a controller based on instructions stored on a memory of the controller and in conjunction with signals received from sensors of the engine system, such as the sensors described above with reference to FIG. 1. The controller may employ engine actuators of the engine system to adjust engine operation, according to the methods described below.

At 202, the method includes estimating and/or measuring engine operating conditions. These include, for example, engine temperature, ambient conditions (such as ambient temperature, pressure, and humidity), engine load, driver demand, etc.

At 204, it may be determined if the engine is being started from rest. In one example, an engine restart may be confirmed responsive to an ignition key-on event, or an alternate vehicle-on event. As another example, in engines configured with start-stop systems, an engine restart may be confirmed responsive to an increase in driver demand following an engine idle-stop.

An engine start may not be confirmed if the engine has already surpassed engine cranking speed (or has exceeded a first number of combustion events since a last engine start), and nominal engine operation is continuing. If an engine start is not confirmed, at 206, the routine includes fueling the engine with a fuel mass and a split ratio of port injected fuel to direct injected fuel selected based on one or more of the estimated engine operating conditions. In particular, the split ratio may be adjusted based on engine operating parameters while maintaining a commanded fuel mass even as fuel mass changes. For example, the split ratio may be determined based on engine load, engine temperature, exhaust temperature, and/or likelihood of knock. As another example, the split ratio of fuel injected via port injection relative to direct injection may be based on driver torque demand, the ratio of port injection relative to direct injection decreased as the driver demand increases.

If an engine start is confirmed, at 208, the engine may be fueled via each of port injection and direct injection. A ratio of port injected fuel relative to direct injected fuel may be selected based on engine conditions at the engine start (e.g., engine conditions before any fueling is initiated), such as engine temperature. As an example, the ratio of port injected fuel to direct injected fuel may be increased as the engine temperature at a first combustion event of the start decreases. Thus, a higher proportion of the total fuel mass may be delivered as a port injection during a cold-start of the engine as compared to a hot start of the engine. The ratio may be further selected based on an alcohol content or octane rating of the fuel being injected by the port and direct injectors.

At 210, the method includes computing PFI and DI fuel masses for an upcoming combustion event (such as a first combustion event of the engine start as well as a first number of consecutive combustion events counted from the first combustion event of the engine start) based on the selected ratio. Herein, for each combustion event, the controller may compute a total fuel mass to be delivered into a cylinder, and then based on the selected split ratio, the controller may compute the total fuel mass to be delivered into the cylinder via the port injector and via the direct injector.

At 212, the method includes scheduling PFI and DI fuel pulses based on the determined fuel masses. Herein, based on the relative fuel mass to be delivered via each injector, a start and end of injection timing may be determined which enables the determined fuel mass to be delivered via each injector at a target average injection timing. The controller may send a signal to actuate a solenoid valve of the corresponding fuel injectors to open and close the valves, thereby initiating and ending fuel injection, based on the determined start and end of injection timing.

At 214, while injecting the fuel according to the scheduled fuel pulses, a counter may be set to count each combustion event number of the engine start. Thus, a first combustion event may be defined as a combustion event occurring following fueling in a first cylinder during the engine start from rest, wherein prior to the first combustion event, the engine was at rest and was not receiving fuel, and wherein the engine starts to spin up as a result of the first combustion event.

At 216, it may be determined if a decrease in fuel mass was commanded. As such, the engine may be fueled with a higher fuel mass during initial combustion events of the engine start and a decrease in fuel mass may be commanded as or after the engine exits a cranking speed. In one example, the decrease in commanded fuel mass may be responsive to the engine cranking speed exceeding the cranking speed. In another example, the decrease in commanded fuel mass may be responsive to a decrease in air charge. If a decrease in fuel mass is not commanded, then at 218, fuel is continued to be injected as scheduled.

If a decrease in fuel mass is commanded, at 220, it may be determined if the combustion event number where the decrease in fuel mass was commanded is less than a threshold number. The threshold number may be predefined number corresponding to a first number of combustion events since the engine start. That is, it is determined if the engine is still within the first number of combustion events since the start. As discussed above, the combustion events may be counted from an engine start where the engine speed is zero (at rest), with an initial combustion event where fueling of the engine is initiated counted as a first combustion event (e.g., referenced as number 1). Each combustion event thereafter is counted as a single combustion event and the combustion event number is incremented by one on each event (e.g., referenced to as number 2, 3, 4, and so on until engine fueling is discontinued). For a first number of consecutively occurring combustion events since the first combustion event (e.g., for combustion events numbered 1 through n), a ratio of fuel injected via port injection relative to direct injection may be maintained even as the fuel mass changes so as to improve air-fuel mixture formation while the engine is being cranked and to improve overall engine start robustness.

Thus if the decrease in fuel mass is commanded before the first number of combustion events have occurred, at 222, a timing of the fuel mass decrease command is determined in relation to a port injection window. In particular, it may be determined if the command is received when (or after) the PFI abort angle has been reached. In one example, the PFI abort angle may not have been reached if the command is received earlier in the port injection window, such as while there is more than a threshold number of crank angle degrees to an end of the port injection window. In another example, the PFI abort angle may have been reached if the command is received later in the port injection window, such as while there is less than a threshold number of crank angle degrees to an end of the port injection window. As such, if a fuel command is received after the abort angle is reached, adjustments to a PFI fuel pulse may not be possible.

If the abort angle has not been reached, then at 224, in response to a decrease in fuel mass being commanded earlier during the port injection window of a combustion event within the first number of combustion events, the method includes trimming the port injection fuel pulse (of the given combustion event) based on the commanded decrease in fuel mass. In addition, a direct injection fuel pulse (of the given combustion event) is trimmed based on the trimming of the port injection fuel pulse while maintaining the earlier selected split ratio of port injected fuel relative to direct injected fuel. Trimming the port injection fuel pulse includes advancing an end of injection timing/angle of the port injection. Likewise, trimming the direct injection fuel pulse includes advancing an end of injection timing/angle of the direct injection. As a result of the trimming, the commanded decrease in fuel mass is met while maintaining the initially selected split ratio.

If the abort angle has been reached, then at 226, in response to a decrease in fuel mass being commanded later during the port injection window of a combustion event within the first number of combustion events, the method includes maintaining the port injection fuel pulse (of the given combustion event). In addition, a direct injection fuel pulse (of the given combustion event) is not trimmed so as to maintain the earlier selected split ratio of port injected fuel relative to direct injected fuel. Herein, due to the inability to adjust the port injection pulse, due to the abort angle being reached or surpassed, the direct injector pulse is maintained, thereby prioritizing maintenance of the split ratio over meeting the commanded decrease in fuel mass. As a result of not trimming either the port or direct injection pulse, the actual fuel mass injected into the engine cylinder (when the decrease in fuel mass is commanded later in the port injection window) is higher than the commanded fuel mass. As a result of not trimming either pulse, the commanded decrease in fuel mass is not met so to enable the initially selected split ratio to be maintained.

Additionally, responsive to the delivery of fuel in excess of demanded fuel, one or more parameters may be adjusted. For example, intake port fuel puddle model dynamics for a subsequent combustion event may be adjusted responsive to (and as a function of) the actual fuel mass injected being higher than the commanded fuel mass.

In both cases, by maintaining the split ratio as fuel mass changes within a first number of combustion events since the engine start, combustion stability during the combustion events is improved, and engine starts are made more repeatable.

In still further examples, it may be determined if an increase in fuel mass was commanded at 216. In one example, the engine may be fueled with a higher fuel mass during initial combustion events of the engine start. For example, the increase in commanded fuel mass may be responsive to the engine speed being below the cranking speed. In another example, the increase in commanded fuel mass may be responsive to an increase in air charge. If an increase in fuel mass is commanded and the combustion event number where the increase in fuel mass was commanded is less than the threshold number (e.g., less than a predefined number corresponding to a first number of combustion events counted since the engine start), then the ratio of fuel injected via port injection relative to direct injection may be maintained even as the fuel mass changes so as to improve air-fuel mixture formation while the engine is being cranked and to improve overall engine start robustness. In particular, responsive to the commanded increase in fuel mass before the first number of combustion events have occurred, a timing of the fuel mass increase command is determined in relation to a port injection window to identify if the command was received before or after the PFI abort angle has been reached. If the increase in fuel mass command is received earlier in the port injection window, before the PFI abort angle is reached, the port injection fuel pulse (of the given combustion event) may be extended based on the commanded increase in fuel mass, such as by retarding an end of injection timing/angle of the port injection. In addition, a direct injection fuel pulse (of the given combustion event) is extended, such as by retarding an end of injection timing/angle of the direct injection, based on the adjustment to the port injection fuel pulse to maintain the earlier selected split ratio of port injected fuel relative to direct injected fuel while meeting the increased demand for fuel. However, if the increase in fuel command is received after the abort angle has been reached, then the port injection fuel pulse (of the given combustion event) is maintained and further the direct injection fuel pulse (of the given combustion event) is also maintained so as to maintain the earlier selected split ratio of port injected fuel relative to direct injected fuel. Herein, due to the inability to adjust the port injection pulse, due to the abort angle being reached or surpassed, the direct injector pulse is maintained, thereby prioritizing maintenance of the split ratio over meeting the commanded increase in fuel mass. As a result, the actual fuel mass injected into the engine cylinder (when the increase in fuel mass is commanded later in the port injection window) is lower than the commanded fuel mass. Additionally, responsive to the delivery of fuel in deficit of demanded fuel, one or more parameters may be adjusted. For example, intake port fuel puddle model dynamics for a subsequent combustion event may be adjusted responsive to (and as a function of) the actual fuel mass injected being lower than the commanded fuel mass. In addition, a port and direct injection fuel pulse for a subsequent combustion event may be extended to compensate for the fuel deficit while maintaining the split ratio for that combustion event.

Returning to 220, if the decrease (or increase) in fuel mass is commanded after the first number of combustion events have elapsed, at 230, as at 222, a timing of the fuel mass decrease command is determined in relation to the port injection window. In particular, it may be determined if the command is received when (or after) the PFI abort angle has been reached. As such, after the first number of combustion events have passed, the controller may reprioritize the commanded fuel mass over the commanded split ratio. This is because the effect of a change in split ratio on engine startability may be less pronounced after the first number of combustion events have elapsed, and when the engine has exited the cranking speed.

If the abort angle has not been reached, then at 232, in response to a decrease in fuel mass being commanded earlier during the port injection window of a combustion event after the first number of combustion events, the method includes trimming one or both of the port injection fuel pulse and the direct injection fuel pulse (of the given combustion event) based on the commanded decrease in fuel mass. As one example, the PFI fuel pulse may be trimmed while the DI fuel pulse is maintained. Trimming the port injection fuel pulse may include advancing an end of injection timing/angle of the port injection. The trimming may be performed so that the actual fuel mass delivered to the cylinder matches the commanded (decreased) fuel mass without requiring the initially selected split ratio be maintained for that combustion event.

Likewise, in response to an increase in fuel mass being commanded earlier during the port injection window of a combustion event after the first number of combustion events, the method includes extending one or both of the port injection fuel pulse and the direct injection fuel pulse (of the given combustion event) based on the commanded increase in fuel mass. As one example, the PFI fuel pulse may be extended while the DI fuel pulse is maintained by retarding an end of injection timing/angle of the port injection. The extending may be performed so that the actual fuel mass delivered to the cylinder matches the commanded (increased) fuel mass without requiring the initially selected split ratio be maintained for that combustion event. As another example, the DI fuel pulse may be extended while the PFI fuel pulse is maintained by retarding an end of injection timing/angle of the direct injection. The extending may be performed so that the actual fuel mass delivered to the cylinder matches the commanded (increased) fuel mass without requiring the initially selected split ratio be maintained for that combustion event. As still another example, each of the PFI and DI fuel pulses may be extended by retarding an end of injection timing/angle of the fuel pulses so that the actual fuel mass delivered to the cylinder matches the commanded (increased) fuel mass without requiring the initially selected split ratio be maintained for that combustion event. In one example, as the commanded fuel mass increases (after the threshold number of combustion events have elapsed), the DI and PFI fuel pulses may be adjusted to either maintain or decrease the split ratio of port injected fuel to direct injected fuel.

If the abort angle has been reached, then at 234, in response to a decrease in fuel mass being commanded later during the port injection window of a combustion event after the first number of combustion events, the method includes maintaining the port injection fuel pulse (of the given combustion event) while trimming the direct injection fuel pulse (of the given combustion event) so as to provide the commanded fuel mass. Trimming the direct injection fuel pulse may include advancing an end of injection timing/angle of the direct injection. Herein, due to the inability to adjust the port injection pulse, due to the abort angle being reached or surpassed, the direct injector pulse is trimmed, thereby prioritizing meeting the commanded decrease in fuel mass over maintenance of the split ratio.

Additionally, responsive to the delivery of fuel in excess of demanded fuel, one or more parameters may be adjusted. For example, intake port fuel puddle model dynamics for a subsequent combustion event may be adjusted responsive to (and as a function of) the actual fuel mass injected being higher than the commanded fuel mass.

Likewise, in response to an increase in fuel mass being commanded later during the port injection window of a combustion event after the first number of combustion events, the port injection fuel pulse (of the given combustion event) is maintained while extending the direct injection fuel pulse (of the given combustion event) by retarding an end of injection timing/angle of the direct injection. Herein, due to the inability to adjust the port injection pulse, due to the abort angle being reached or surpassed, the direct injector pulse is extended, thereby prioritizing meeting the commanded increase in fuel mass over maintenance of the split ratio. In particular, this results in the split ratio of port:direct injected fuel being decreased.

Additionally, responsive to the delivery of fuel in deficit of demanded fuel, one or more parameters may be adjusted. For example, intake port fuel puddle model dynamics for a subsequent combustion event may be adjusted responsive to (and as a function of) the actual fuel mass injected being lower than the commanded fuel mass. In addition, a port and direct injection fuel pulse for a subsequent combustion event may be extended to compensate for the fuel deficit while maintaining the split ratio for that combustion event.

In both cases, by meeting the commanded fuel mass independent of the split ratio as fuel mass changes after the first number of combustion events since the engine start, engine performance is improved, and driver demand is better met.

As such, due to the trimming of the port and/or direct injection pulse, the actual fuel mass injected into the engine cylinder when the decrease in fuel mass is commanded later in the port injection window after the first number of combustion events is higher than the actual fuel mass injected when the decrease in fuel mass is commanded later in the port injection window within the first number of combustion events.

Example fuel pulse adjustments are now shown with reference to FIG. 3. Map 300 depicts changes in engine speed at plot 302, a commanded fuel mass at plot 304, and a delivered fuel pulse at plot 306. In plot 306, for each combustion event, a portion of the total fuel mass delivered as a port injection fuel pulse is shown by a solid bar while the portion of the total fuel mass delivered as a direct injection fuel pulse is shown by a hatched bar. All plots are shown over a number of combustion events that increment along the x-axis from left to right. The numbering of consecutive combustion events following a first engine start is shown starting at n1 wherein n1 represents a first combustion event of the first engine start from rest. A numbering of consecutive combustion events following a second, subsequent engine start is shown starting at m1 wherein m1 represents a first combustion event of the second start from rest.

Plot 302 shows an increase in engine speed from zero responsive to a first engine start. Herein the first engine start is a cold-start wherein the engine is started while the engine temperature is lower. A first combustion event n1 of the first engine start from rest is initiated by injecting fuel into the cylinder with a first split ratio of port injected fuel to direct injected fuel. Due to the first start being a cold-start, the first split ratio includes a higher proportion of port injected fuel relative to direct injected fuel, to reduce cold-start exhaust emissions. In one example, the first split ratio includes 60% PFI:40% DI.

The fuel mass commanded (plot 304) is adjusted over each subsequent combustion event to enable the depicted engine speed profile (plot 302) to be provided. In particular, the commanded fuel mass is increased during an initial part of the engine start while the engine is being cranked, and then decreased. After a threshold number of combustion events, herein depicted at combustion event n21 as a non-limiting example, the engine reaches cranking speed and cranking is exited. Therefore between n1 and n21, the engine controller prioritizes maintenance of the selected split ratio over ensuring that the actual fuel mass meets the commanded fuel mass.

At combustion event n14, a first decrease in fuel mass is commanded. The command for n14 is received during the port injection window, before the abort angle is reached. Consequently, the controller meets both the split ratio and the commanded fuel mass by advancing an end of injection of each of the PFI (solid bar) and DI (hatched bar) fuel pulses.

At combustion event n15, a second decrease in fuel mass is commanded. The command for n15 is received during the port injection window, after the abort angle is reached. Since this decrease in fuel mass is received before the threshold number of combustion events have elapsed (before n21), the controller aims to maintain the split ratio first. Since the command is received too late in the port injection window and adjustments to the PFI pulse are not possible, the PFI fuel pulse is maintained while the DI pulse is also maintained so as to maintain the selected split ratio. As a result, fuel in excess of what was commanded (indicated at dashed line 307) is provided. The same occurs for combustion event n16 with a resulting delivery of excess fuel (indicated at dashed line 308) while the split ratio is maintained. In this way, the selected split ratio is maintained until n21 is reached, even as fuel mass changes, allowing for improved engine startability.

After n21, the split ratio may be varied as engine operating conditions change. For example, a higher proportion of DI may be applied at higher engine speeds and load. Also after n21, even as fuel mass changes, the fuel injection pulses are adjusted so that the actual fuel mass meets the commanded fuel mass, while allowing for deviations from the target split ratio. For example, after n21, in response to a decrease in commanded fuel mass, an end of injection of each PFI and DI fuel pulse are advanced when the command is earlier in the port injection window, and an end of injection of only the DI fuel pulse is advanced when the command is later in the port injection window. At n56, a last combustion event occurs before fueling is discontinued and the engine is spun down to rest.

Plot 302 shows a subsequent increase in engine speed from zero responsive to a second engine start, following the first engine start. Due to a short duration having elapsed since the engine being shut down after n56, the second engine start is a hot start wherein the engine is started while the engine temperature is higher. A first combustion event m1 of the first engine start from rest is initiated by injecting fuel into the cylinder with a second split ratio of port injected fuel to direct injected fuel. Due to the second start being a hot-start, the second split ratio includes a smaller proportion of port injected fuel relative to direct injected fuel. In one example, the first split ratio includes 30% PFI:70% DI.

The fuel mass commanded (plot 304) is adjusted over each subsequent combustion event to enable the depicted engine speed profile (plot 302) to be provided. In particular, the commanded fuel mass is increased during an initial part of the engine start while the engine is being cranked, and then decreased. After a threshold number of combustion events, herein depicted at combustion event m21 as a non-limiting example, the engine reaches cranking speed and cranking is exited. Therefore between m1 and m21, the engine controller prioritizes maintenance of the selected split ratio over ensuring that the actual fuel mass meets the commanded fuel mass. It will be appreciated that in alternate examples, the threshold number of combustion events over which the split ratio is maintained may be different for a hot start versus a cold start of the engine.

At combustion event m14, a first decrease in fuel mass is commanded. The command for m14 is received during the port injection window, before the abort angle is reached. Consequently, the controller meets both the split ratio and the commanded fuel mass by advancing an end of injection of each of the PFI (solid bar) and DI (hatched bar) fuel pulses.

At combustion event m15, a second decrease in fuel mass is commanded. The command for m15 is received during the port injection window, after the abort angle is reached. Since this decrease in fuel mass is received before the threshold number of combustion events have elapsed (before n21), the controller aims to maintain the split ratio first. Since the command is received too late in the port injection window and adjustments to the PFI pulse are not possible, the PFI fuel pulse is maintained while the DI pulse is also maintained so as to maintain the selected split ratio. As a result, fuel in excess of what was commanded (indicated at dashed line 309) is provided. The same occurs for combustion event n16 with a resulting delivery of excess fuel (indicated at dashed line 310) while the split ratio is maintained. In this way, the selected (second) split ratio is maintained until m21 is reached, even as fuel mass changes, allowing for improved engine startability.

After m21, the split ratio may be varied as engine operating conditions change. For example, a higher proportion of DI may be applied at higher engine speeds and load. Also after m21, even as fuel mass changes, the fuel injection pulses are adjusted so that the actual fuel mass meets the commanded fuel mass, while allowing for deviations from the target split ratio. For example, after m21, in response to a decrease in commanded fuel mass, an end of injection of each PFI and DI fuel pulse are advanced when the command is earlier in the port injection window, and an end of injection of only the DI fuel pulse is advanced when the command is later in the port injection window.

In an alternate example, during the cold-start, for the threshold number of combustion events occurring successively since a first combustion event, the controller may maintain the selected ratio of fuel delivered via port injection relative to direct injection as the commanded fuel mass decreases. This may result in the actual fuel mass delivered deviating from the commanded fuel mass. In comparison, during the hot-start, for the threshold number of combustion events occurring successively since a first combustion event, the controller may maintain actual fuel mass at the commanded fuel mass as the commanded fuel mass decreases. This may result in the actual fuel split ratio delivered deviating from the selected/commanded fuel split ratio.

For example, over a number of combustion events occurring consecutively since a first combustion event of a first engine start from rest, a controller may maintain a ratio of fuel delivered via port injection relative to direct injection as a commanded fuel mass decreases. In comparison, over the number of combustion events occurring consecutively since the first combustion event of a second engine start from rest, adjusting the ratio of fuel directed via port injection relative to direct injection while maintaining actual fuel mass at the commanded fuel mass as the commanded fuel mass decreases. During the first engine start, the actual fuel mass may not be maintained at the commanded fuel mass as the commanded fuel mass decreases. In particular, during the first engine start, the actual fuel mass injected into an engine cylinder may be higher than the commanded fuel mass. Also, during the first engine start, a decrease in the commanded fuel mass is commanded earlier in a port injection window as compared to the decrease in commanded fuel mass commanded during the second engine start. Maintaining the ratio during the engine start may include advancing an end of a port injection fuel pulse based on the commanded fuel mass decrease and advancing an end of a direct injection fuel pulse based on the advancing of the end of the port injection fuel pulse. Adjusting the ratio while maintaining the actual fuel mass may include maintaining the end of the port injection fuel pulse and maintaining the end of the direct injection fuel pulse while disregarding the commanded fuel mass decrease.

It will be appreciated that while the example of FIG. 3 is shown with reference to a commanded decrease in fuel mass, similar adjustments may be performed in response to a commanded increase in fuel mass. For example, in response to a commanded increase in fuel mass received before a threshold number of combustion events, the DI and PFI fuel pulses are adjusted to maintain the split ratio even if the commanded fuel mass is not provided (e.g., the fuel mass may be lower than desired). In response to a commanded increase in fuel mass received after a threshold number of combustion events, the DI and PFI fuel pulses are adjusted to provide the commanded fuel mass even if the commanded split ratio is not met (e.g., the split ratio may be lower than desired).

In this way, quality of engine starts are improved. The technical effect of maintaining a fuel split ratio constant for a defined number of combustion events occurring successively since a first combustion event of an engine start from rest (zero speed), air-fuel mixture formation during engine cranking may be improved, allowing for higher combustion stability. By reducing variability in the split fuel ratio, deviations from a calibrated spark timing are reduced, improving engine start performance. By enabling a split ratio commanded for the defined number of combustion events since a first combustion event of the engine start to be maintained, while allowing for deviations in the actual fuel mass from the commanded fuel mass, engine start variability due to a decrease in fuel mass during engine run-up and cranking may be reduced. Overall, engine starts are made more reproducible.

One example method for an engine comprises: for a first number of consecutive combustion events counted from a first combustion event of an engine start from rest, fueling an engine with each of port and direct injection; and maintaining a ratio of fuel injected via port injection relative to direct injection over the first number of combustion events even as fuel mass changes. The preceding example, additionally or optionally, further comprises, after the first number of consecutive combustion events has elapsed, adjusting the ratio of fuel injected via port injection relative to direct injection based on driver demand while maintaining a commanded fuel mass even as the fuel mass changes. In any or all of the preceding examples, additionally or optionally, the ratio of fuel injected via port injection relative to direct injection is maintained or decreased as the commanded fuel mass increases. In any or all of the preceding examples, additionally or optionally, the maintaining includes, in response to a decrease in fuel mass being commanded earlier during a port injection window of a combustion event of the first number of combustion events, trimming a port injection fuel pulse based on the decrease in fuel mass and trimming a direct injection fuel pulse of the combustion event based on the trimming of the port injection fuel pulse while maintaining the ratio. In any or all of the preceding examples, additionally or optionally, the maintaining further includes, in response to the decrease in fuel mass being commanded later during the port injection window of the combustion event, maintaining the port injection fuel pulse and not trimming the direct injection fuel pulse to maintain the ratio. In any or all of the preceding examples, additionally or optionally, earlier during the port injection window includes while there is more than a threshold number of crank angle degrees to an end of the port injection window, and wherein later during the port injection window includes while there is less than the threshold number of crank angle degrees to the end of the port injection window. In any or all of the preceding examples, additionally or optionally, the actual fuel mass injected when the decrease in fuel mass is commanded later during the port injection window is higher than a commanded fuel mass. In any or all of the preceding examples, additionally or optionally, the method further comprises, adjusting intake port fuel puddle model dynamics for a subsequent combustion event responsive to the actual fuel mass injected being higher than the commanded fuel mass. In any or all of the preceding examples, additionally or optionally, trimming the direct injection fuel pulse includes advancing an end of injection angle of the direct injection fuel pulse. In any or all of the preceding examples, additionally or optionally, the ratio is based on engine temperature at the engine start, the ratio including a higher ratio of port injected fuel to direct injected fuel as the engine temperature at the first combustion event of the engine start decreases.

Another example engine method comprises: over a number of combustion events occurring consecutively since a first combustion event of a first engine start from rest, maintaining a ratio of fuel delivered via port injection relative to direct injection as a commanded fuel mass decreases; and over the number of combustion events occurring consecutively since the first combustion event of a second engine start from rest, adjusting the ratio of fuel directed via port injection relative to direct injection while maintaining actual fuel mass at the commanded fuel mass as the commanded fuel mass decreases. In the preceding example, additionally or optionally, during the first engine start, the actual fuel mass is not maintained at the commanded fuel mass as the commanded fuel mass decreases. In any or all of the preceding examples, additionally or optionally, during the first engine start, a decrease in the commanded fuel mass is commanded earlier in a port injection window as compared to the decrease in commanded fuel mass commanded during the second engine start. In any or all of the preceding examples, additionally or optionally, maintaining the ratio during the engine start includes advancing an end of a port injection fuel pulse based on the commanded fuel mass decrease and advancing an end of a direct injection fuel pulse based on the advancing of the end of the port injection fuel pulse. In any or all of the preceding examples, additionally or optionally, adjusting the ratio while maintaining the actual fuel mass includes maintaining the end of the port injection fuel pulse and maintaining the end of the direct injection fuel pulse while disregarding the commanded fuel mass decrease. In any or all of the preceding examples, additionally or optionally, during the first engine start, the actual fuel mass injected into an engine cylinder is higher than the commanded fuel mass.

Another example engine fuel system comprises: an engine cylinder; a direct injector coupled to the cylinder; a port injector coupled to the cylinder; and a controller configured with computer readable instructions stored on non-transitory memory for: restarting an engine with fuel delivered into the cylinder on a first combustion event from rest from each of the port injector and the direct injector at a ratio; adjusting a fuel mass commanded to the cylinder based on a combustion event number since the first combustion event until a threshold number of combustion events have elapsed; when a commanded decrease in fuel mass is received within a threshold number of crank angle degrees of a port injection window, adjusting each of a port injection fuel pulse and a direct injection fuel pulse to provide the commanded decrease in fuel mass while adjusting the ratio; and when the commanded decrease in fuel mass is received outside the threshold number of crank angle degrees of the port injection window, maintaining each of the port injection fuel pulse and the direct injection fuel pulse to maintain the ratio while providing an actual fuel mass that is higher than a commanded fuel mass. In the preceding example, additionally or optionally, adjusting each of the port injection fuel pulse and the direct injection fuel pulse includes advancing an end of injection timing of each of the port injection fuel pulse and the direct injection fuel pulse. In any or all of the preceding examples, additionally or optionally, maintaining each of the port injection fuel pulse and the direct injection fuel pulse includes maintaining the end of injection timing of each of the port injection fuel pulse and the direct injection fuel pulse. In any or all of the preceding examples, additionally or optionally, the ratio is based on an engine temperature estimated before the first combustion event at the engine start, the ratio including a higher proportion of port injected fuel relative to direct injected fuel as the engine temperature decreases.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An engine fuel system, comprising:

an engine cylinder;

a direct injector coupled to the cylinder;

a port injector coupled to the cylinder; and a controller with computer readable instructions stored on non-transitory memory for:

restarting an engine with fuel delivered into the cylinder on a first combustion event from rest from each of the port injector and the direct injector at a ratio;

adjusting a fuel mass commanded to the cylinder based on a combustion event number since the first combustion event until a threshold number of combustion events have elapsed;

when a commanded decrease in fuel mass is received within a threshold number of crank angle degrees of a port injection window, adjusting each of a port injection fuel pulse and a direct injection fuel pulse to provide the commanded decrease in fuel mass while adjusting the ratio; and when the commanded decrease in fuel mass is received outside the threshold number of crank angle degrees of the port injection window, maintaining each of the port injection fuel pulse and the direct injection fuel pulse to maintain the ratio while providing an actual fuel mass that is higher than a commanded fuel mass.

2. The system of claim 1, wherein adjusting each of the port injection fuel pulse and the direct injection fuel pulse includes advancing an end of injection timing of each of the port injection fuel pulse and the direct injection fuel pulse.

3. The system of claim 2, wherein maintaining each of the port injection fuel pulse and the direct injection fuel pulse includes maintaining the end of injection timing of each of the port injection fuel pulse and the direct injection fuel pulse.

4. The system of claim 1, wherein the ratio is based on an engine temperature estimated before the first combustion event at the engine start, the ratio including a higher proportion of port injected fuel relative to direct injected fuel as the engine temperature decreases.

5. A method for an engine, comprising:

for a first number of consecutive combustion events counted from a first combustion event of an engine start from rest, fueling an engine with each of port and direct injection; and maintaining a ratio of fuel injected via port injection relative to direct injection over the first number of combustion events even as fuel mass changes.

6. The method of claim 5, further comprising, after the first number of consecutive combustion events has elapsed, adjusting the ratio of fuel injected via port injection relative to direct injection based on driver demand while maintaining a commanded fuel mass even as the fuel mass changes.

7. The method of claim 6, wherein the ratio of fuel injected via port injection relative to direct injection is maintained or decreased as the commanded fuel mass increases.

8. The method of claim 5, wherein the maintaining includes, in response to a decrease in fuel mass being commanded earlier during a port injection window of a combustion event of the first number of combustion events, trimming a port injection fuel pulse based on the decrease in fuel mass and trimming a direct injection fuel pulse of the combustion event based on the trimming of the port injection fuel pulse while maintaining the ratio.

9. The method of claim 8, wherein the maintaining further includes, in response to the decrease in fuel mass being commanded later during the port injection window of the combustion event, maintaining the port injection fuel pulse and not trimming the direct injection fuel pulse to maintain the ratio.

10. The method of claim 9, wherein earlier during the port injection window includes while there is more than a threshold number of crank angle degrees to an end of the port injection window, and wherein later during the port injection window includes while there is less than the threshold number of crank angle degrees to the end of the port injection window.

11. The method of claim 9, wherein the actual fuel mass injected when the decrease in fuel mass is commanded later during the port injection window is higher than a commanded fuel mass.

12. The method of claim 11, further comprising, adjusting intake port fuel puddle model dynamics for a subsequent combustion event responsive to the actual fuel mass injected being higher than the commanded fuel mass.

13. The method of claim 8, wherein trimming the direct injection fuel pulse includes advancing an end of injection angle of the direct injection fuel pulse.

14. The method of claim 5, wherein the ratio is based on engine temperature at the engine start, the ratio including a higher ratio of port injected fuel to direct injected fuel as the engine temperature at the first combustion event of the engine start decreases.

15. An engine method, comprising:

over a number of combustion events occurring consecutively since a first combustion event of a first engine start from rest, maintaining a ratio of fuel delivered via port injection relative to direct injection as a commanded fuel mass decreases; and over the number of combustion events occurring consecutively since the first combustion event of a second engine start from rest, adjusting the ratio of fuel directed via port injection relative to direct injection while maintaining actual fuel mass at the commanded fuel mass as the commanded fuel mass decreases.

16. The method of claim 15, wherein during the first engine start, the actual fuel mass is not maintained at the commanded fuel mass as the commanded fuel mass decreases.

17. The method of claim 15, wherein during the first engine start, a decrease in the commanded fuel mass is commanded earlier in a port injection window as compared to the decrease in commanded fuel mass commanded during the second engine start.

18. The method of claim 15, wherein maintaining the ratio during the engine start includes advancing an end of a port injection fuel pulse based on the commanded fuel mass decrease and advancing an end of a direct injection fuel pulse based on the advancing of the end of the port injection fuel pulse.

19. The method of claim 18, wherein adjusting the ratio while maintaining the actual fuel mass includes maintaining the end of the port injection fuel pulse and maintaining the end of the direct injection fuel pulse while disregarding the commanded fuel mass decrease.

20. The method of claim 15, wherein during the first engine start, the actual fuel mass injected into an engine cylinder is higher than the commanded fuel mass.

* * * * *